United States Patent [19]

Reeves, Jr.

[11] Patent Number: 4,735,238

[45] Date of Patent: Apr. 5, 1988

[54] DRUM FILLING METHOD AND APPARATUS

[75] Inventor: Robert H. Reeves, Jr., Freeport, Tex.

[73] Assignee: Velasco Scale Company, Freeport, Tex.

[21] Appl. No.: 938,539

[22] Filed: Dec. 5, 1986

[51] Int. Cl.[4] ..... B65B 3/28

[52] U.S. Cl. ..... 141/1; 141/83; 141/94; 141/128; 141/270; 141/DIG. 1; 53/381 A

[58] Field of Search ..... 141/1–12, 141/128, 83, 94, 95, 96, 98, 37–70, 250–284, 285–310, 374, 375, 87, 90, 93, DIG. 1, 129–192, 325, 326, 327, 379, 380, 381; 53/267, 381 A, 367, 468, 492; 222/70, 77; 177/122; 81/3.2, 3.33

[56] References Cited

U.S. PATENT DOCUMENTS

| | | | |
|---|---|---|---|
| 2,812,919 | 11/1957 | Guerard et al. | 141/374 |
| 4,211,263 | 7/1980 | Kennedy et al. | 141/128 |
| 4,224,968 | 9/1980 | Bosser et al. | 141/374 |
| 4,337,802 | 7/1982 | Kennedy et al. | 141/128 |
| 4,494,583 | 1/1985 | Reeves et al. | 141/83 |
| 4,606,382 | 8/1986 | Biller et al. | 141/374 |
| 4,630,654 | 12/1986 | Kennedy | 141/128 |

*Primary Examiner*—Houston S. Bell, Jr.
*Attorney, Agent, or Firm*—Arnold, White & Durkee

[57] ABSTRACT

Apparatus and method for filling a container with a liquid. Apparatus includes a filling lance for introducing liquid into a container and a bung engaging tool assembly for removing the bung cap from the container prior to filling operations and for replacing the bung cap into the container after filling operations have been completed.

18 Claims, 5 Drawing Sheets

Fig. 8
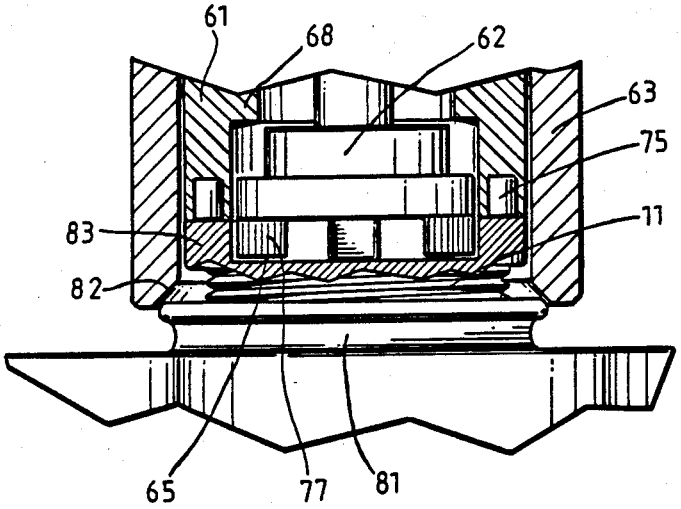
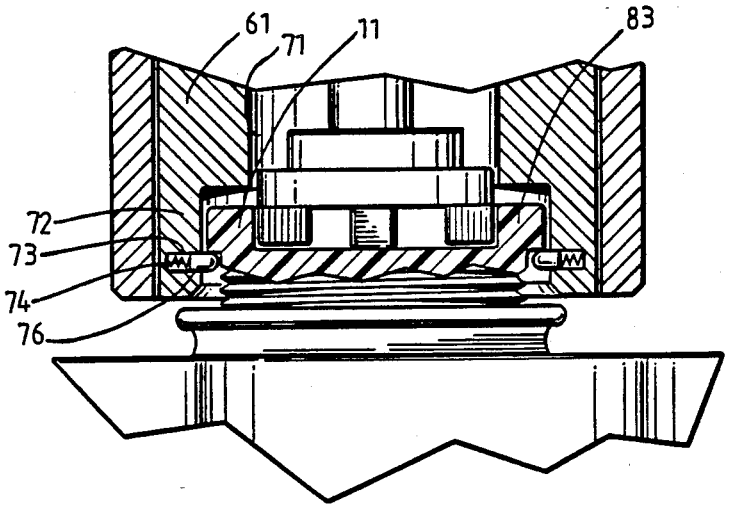
Fig. 9

DRUM FILLING METHOD AND APPARATUS

BACKGROUND OF THE INVENTION

This invention relates to apparatus for dispensing predetermined amounts of liquid by weight into a container and, in particular, is directed toward an improved apparatus and method for dispensing liquid into a container of the type shown in commonly-assigned U.S. Letters Pat. Nos. 4,211,263, 4,337,802 and 4,494,583, said patents and their respective disclosures are hereby incorporated by reference.

Depending upon the nature of the liquid, any of several filling techniques may be utilized to dispense a predetermined, metered amount of liquid into a container, typically a 55 gallon drum. If the liquid is susceptible to foaming, toxic or expells noxious fumes, it is typically the practice to insert a filling lance (the conduit through which the liquid passes into the container) into the container such that the lower discharge end of the lance is in close proximity to the bottom of the container.

The movement of the filling lance, sometimes referred to as a conduit, is initiated by the operator of the filling apparatus. In the preferred filling apparatus utilized in conjunction with the bung engaging tool of this invention a predetermined small amount of liquid is slowly introduced into the container until the level of liquid in the container rises above the discharge end of the lance. Since the discharge end of the lance is thereafter below the level of liquid in the container, most of the remaining volume or weight of the liquid may be introduced into the container at a relatively faster fill rate until the fill rate is decreased (to a dribble fill rate) just before the final weight of liquid has been dispensed. During the fast fill operation, the lance is incrementally withdrawn from the container, but at a rate which maintains the end of the lance below the liquid surface in the container. The withdrawal of the lance is generally controlled by the operator in order to maintain the discharge end of the lance below the liquid fill surface.

Once the predetermined amount of liquid has been introduced into the container, the lance is fully withdrawn. Upon completion of the fill cycle with previous drum filling apparatus, the container would normally be conveyed along the line to another station where the container would be capped or the bung inserted.

A disadvantage of existing commercial systems is that there is no means for automatically removing or inserting the bung cap other than manually. Attempts to automate the process have met with substantial problems in that different brands and types of bung caps are shaped differently and require unique tools for removal and insertion. Prior attempts to design bung insertion and removal apparatus have met with mechanical failure rates below that which are considered acceptable. The novel apparatus of this invention permits the automatic handling of bung caps without requiring operator intervention. Bung caps can now be automatically removed and reinserted during the drum filling sequence.

When working with toxic or noxious liquids, it is desirable to have the container immediately capped as soon as the filling operation is completed, rather than capping the container at another station. Therefore, apparatus that removes a bung from a container prior to filling operations and replaces the bung immediately after filling operations are completed is desired. Such apparatus is desirable for any liquid, but is considered essential for toxic or noxious chemicals.

SUMMARY OF THE INVENTION

The liquid filling apparatus of the subject invention includes a bung engaging tool for removing a bung cap from a container prior to the commencement of filling operations and replacing the bung cap after filling operations have been completed.

In a preferred embodiment of the bung engaging tool, the tool includes a shaft having an alignment housing mounted on it. Also mounted on the shaft are means for engaging the specific bung cap that is being used. Typically such a bung engaging head is mounted on the shaft so that the head can mate with the bung cap during removal, the filling cycle and reinsertion. Means for removing a bung cap from a bunghole of a container are also engaged to the shaft. The alignment housing may encompass a bung engagement means for aligning the bung when the bung is reinserted into the container and may also include a flange for aligning the bung with the flange of the bunghole of the container, enabling the bung to be properly aligned.

The liquid filling apparatus of the subject invention, which includes a bung engaging tool assembly, enables a container to be capped immediately after it has been filled. Therefore, the inclusion of this tool minimizes the exposure to toxic or noxious liquids that are introduced into the containers.

The above and other features and advantages of the present invention will become more apparent from a detailed description of a preferred embodiment when read in conjunction with the drawings.

BRIEF DESCRIPTION OF THE DRAWINGS

FIG. 8 is a cross-sectional view of one embodiment of the bung engagement means and the bung removal means while engaged to a container bung.

FIG. 9 is a cross-sectional view of an alternative embodiment of the bung engagement means and the bung removal means while engaged to a container bung.

DETAILED DESCRIPTION OF THE INVENTION

Figure 1:
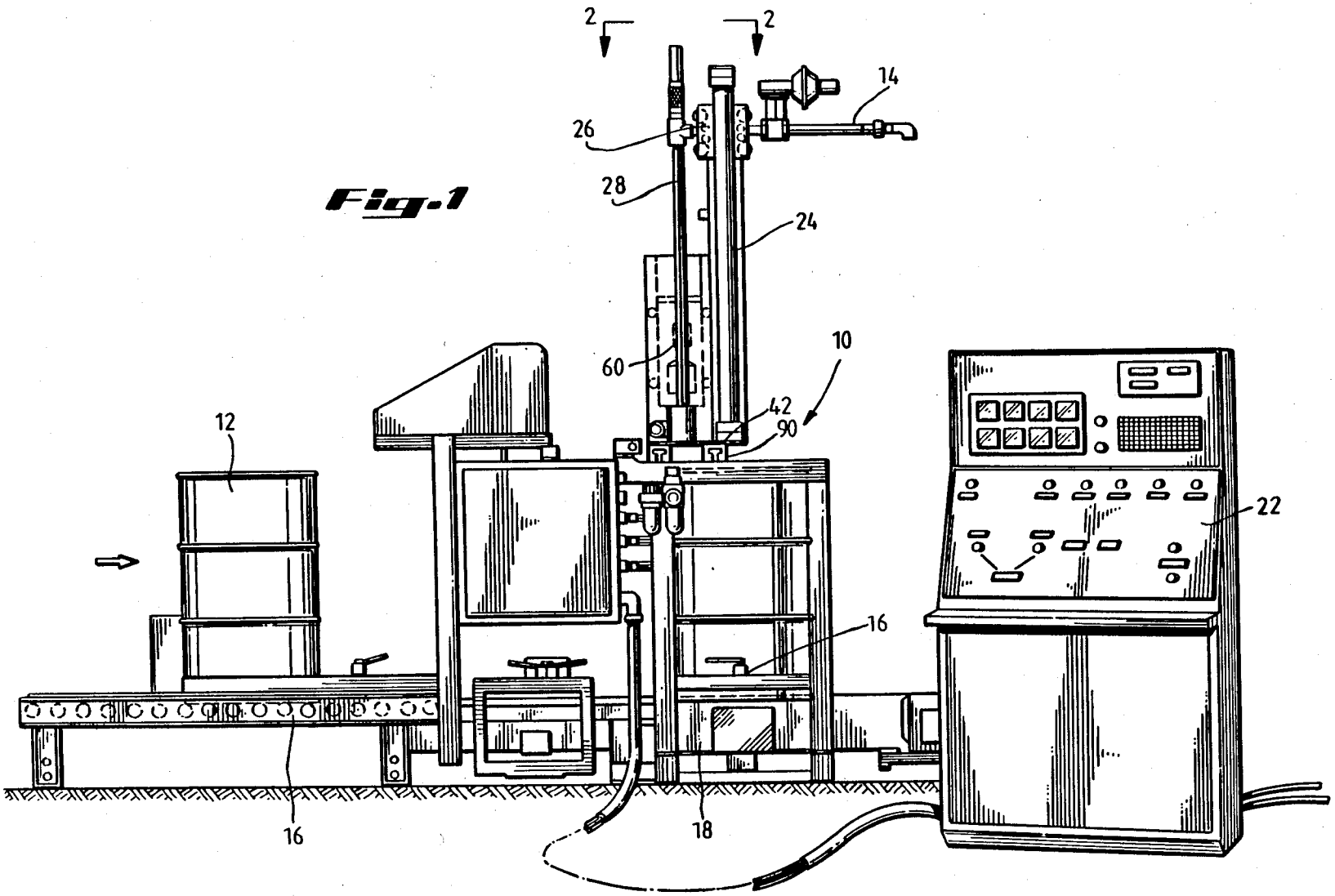
FIG. 1 is a front view of an embodiment of a liquid filling apparatus in accordance with this invention as disposed before a container base or conveying line and with the lance and the bung removal tool in their retracted positions.

Throughout the following detailed description, similar reference numerals refer to similar elements in all FIGS of the drawings.

Referring first to FIG. 1, there is shown a liquid filling apparatus generally indicated by reference numeral 10 in accordance with the present invention. A container 12, which is to be filled with a liquid product from a source or reservoir (not shown), may be conveyed by manual or mechanical means from a receiving or storage area to the filling apparatus 10. If container 12 is transported to filling apparatus 10 with conventional conveying means, then conventional spacing means may be incorporated to space container 12 from the next container that is being transported to filling apparatus 10. Such a container receives a predetermined weight or volume of liquid product from the filling apparatus. The container may then be moved to a discharge area. The container 12 may be in the form of a 55-gallon drum or any other container which has a bung hole and bung cap.

More specifically, a container 12 is moved into position before the filling apparatus 10 on a base area 16 adjacent to the filling apparatus. The base 16 may, for example, be a portion of a conveyor system. Disposed beneath the base is a scale 18 or similar such weight responsive device for determining when the container has been appropriately filled. This scale 18 may consist of mechanical or electronic elements which are capable of generating control signals to a control panel 22 for the filling apparatus 10, such control signals being generated as described in the incorporated references when the predetermined first and second cut-off weights are reached. While control panel 22 is illustrated as a separate assembly in FIG. 1, it should be understood that in other embodiments the control panel is positioned as a contiguous structural component of the filling apparatus. The particular location of the control panel is within the choice, control and convenience of the specific filling apparatus design.

Figure 3:
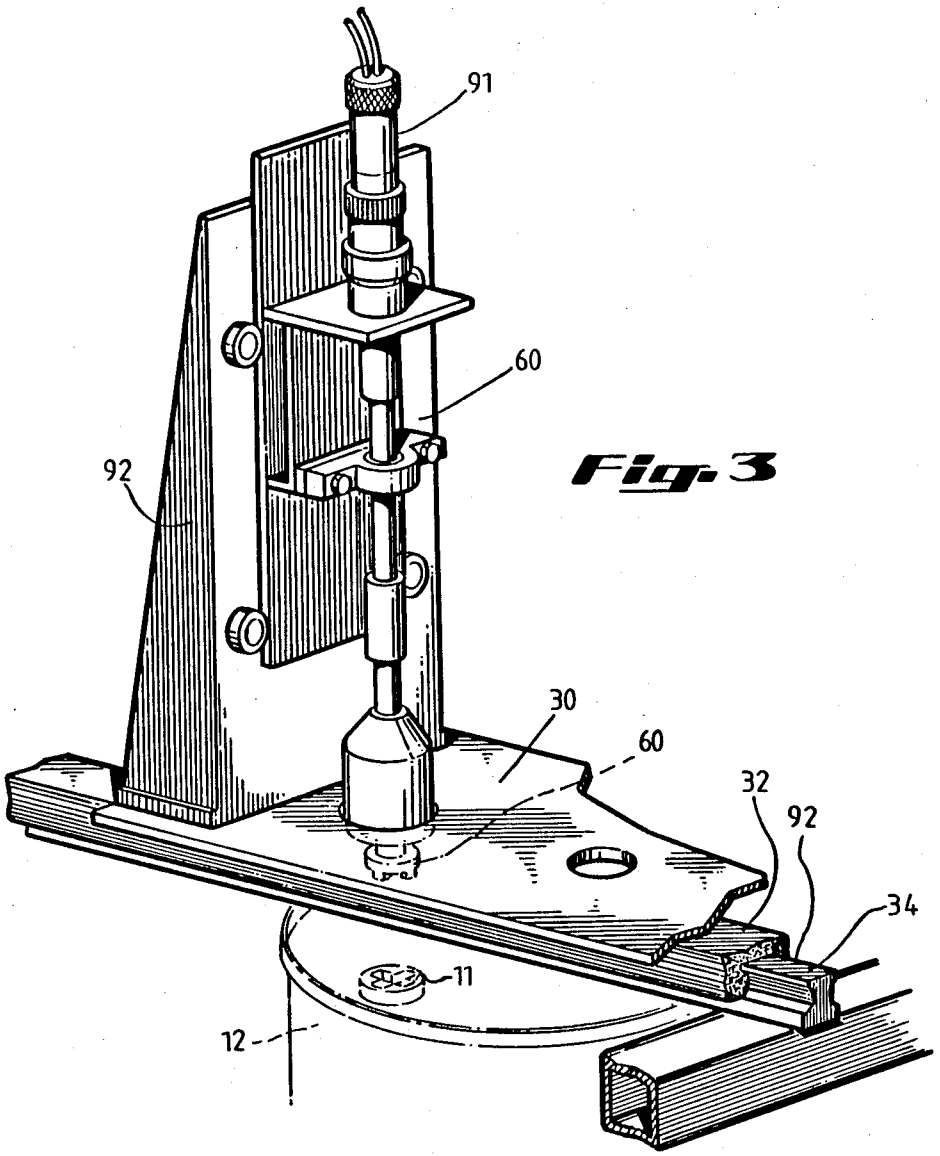
FIG. 3 is a perspective view of the bung removal tool engaging the liquid filling apparatus.

As shown in FIG. 3, the filling apparatus includes stanchion 92 that facilitates the translation of bung removal tool 60 from a position above the container 12 (as shown in FIG. 3) to a position in which bung removal tool 60 engages bung 11 of container 12. Bung removal tool 60 and related components (sometimes referred to collectively as the bung engaging tool assembly) are mounted to stanchion 92. As shown in FIG. 1, filling apparatus 10 also includes stanchion 24 upon which carriage 26 may move to cause the translation of a liquid conduit or filler lance 28 from a position above the container 12 (as shown in FIG. 1) to a position within the container.

The bung engaging tool assembly includes base plate 30 to which stanchion 92 is fixedly attached. Base plate 30 is in turn fixedly attached to sliding member 32, which can be activated to move horizontally by relative sliding action between members 37 and 34. The sliding action of the bung engaging tool assembly along member 34 facilitates the positioning of the bung engaging tool 60 in vertical alignment with the bung cap and hole during removal and insertion. Likewise the movement of bung engaging tool assembly facilitates the relocation of the bung engaging assembly during this filling operation when it is necessary for the lance 28 to be in vertical alignment with the bung hole.

Carriage assembly 90 enables stanchions 24 and 92 to be moved from a position in which stanchion 92 and bung removal tool 60 is aligned with bung 11 to a position in which stanchion 24 and filler lance 28 is aligned with bung 11. A control valve and an actuator, as described in U.S. Pat. No. 4,211,263, incorporated herein by reference, are affixed to the carriage 26 and are disposed between and in communication with the source of liquid (passing through conduit 14), which may be situated behind the filling apparatus 10, and the filler lance 28. The flow of liquid into the container 12 may be introduced at a fast or dribble fill rate pursuant to appropriate actuation of the control valve.

Operations of the filling apparatus 10 as herein described are pneumatically instigated, the pneumatic circuitry being housed in a control panel 22. It will be appreciated, however, that alternative means for actuating the apparatus of this invention, such as electrical signals, could be used. In one preferred embodiment of this invention, hydraulic members are used to actuate the bung engaging means. Thus, it is likewise possible that both pneumatic and hydraulic actuating means may be components of the same filling apparatus.

The control panel 22 includes a start switch (not shown) which is movable between "on" and "off" positions. Movement of the start switch downward generates a start signal, described hereinafter, which initiates the operation of the filling apparatus 10. The pneumatic connections and fittings between the liquid filling apparatus 10 and the control panel 22 are not shown.

When liquids which are toxic, tend to foam or which generate fumes or noxious odors are being introduced into a container, a subsurface fill technique is utilized. The conduit or lance 28 must be introduced into the container until its emission end is disposed just above the bottom of the container. In accordance with the preferred embodiment of the invention, the lance 28 is mounted for vertical reciprocation by the translation of the carriage 26 along the stanchion 24.

As will be appreciated hereinafter, the liquid filler apparatus of this invention may be constructed of standardized components and exhibits a design which is believed manufacturable with a low material and labor cost.

The stanchion 24, in the form of an upright structural H-beam, may be suitably affixed, as by welding or support legs, to a base plate 42 which, in turn, may be secured to carriage 90. A wheeled carriage on the stanchion 24 to reciprocate the filling lance 28. The carriage raises or lowers conduit 28 in response to a signal generated by control panel 22.

The lance 28 is provided with a valve rod which extends centrally and axially therethrough and terminates in a foot valve. The structure and operation of the lance 28 is shown more completely in U.S. Pat. No. 4,337,802, incorporated herein by reference, and especially FIG. 7 of that patent.

The filling apparatus 10 may include an arm assembly which incorporates a lance wiper ring apparatus, a drip collection apparatus and a fume disposal apparatus, all of which are described in patents which have been incorporated herein by reference. As indicated previously, it is often necessary to deal with liquid substances which may be toxic or noxious, and special care must be taken to avoid any contamination or leakage occurring during or as a result of the filling operation. These features may be present in this invention substantially as shown and described in previously incorporated, commonly-assigned U.S. Pat. Nos. 4,211,263 and 4,337,802.

FIG. 3 shows that the filling apparatus 10 includes 9 tool 60 for engaging bung 11 during removal from container 12, before filling operations begin, and for replacing bung 11 into container 12 after filling operations have been completed. Bung engaging tool 60 is slidably mounted on stanchion 92, enabling bung engaging tool 60 to be raised and lowered.

Figure 2:
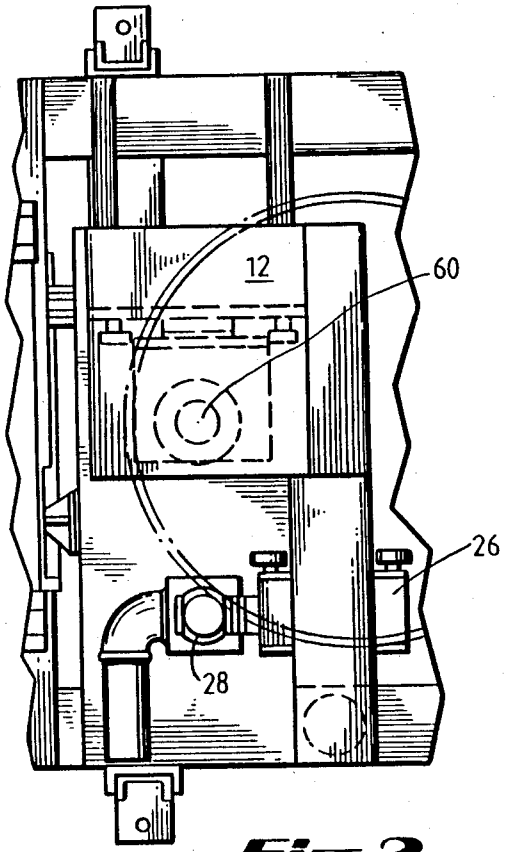
FIG. 2 is a top view of the embodiment shown in FIG. 1, showing the bung removal tool aligned with the bung of a container.

FIG. 2 is a top view of the bung engaging assembling, showing bung engaging tool 60 aligned with the bung of container 12. FIG. 2 shows the orientation of bung engaging tool 60 and filling lance 28, when bung removal tool 60 is aligned with the container's bung.

Figure 4:
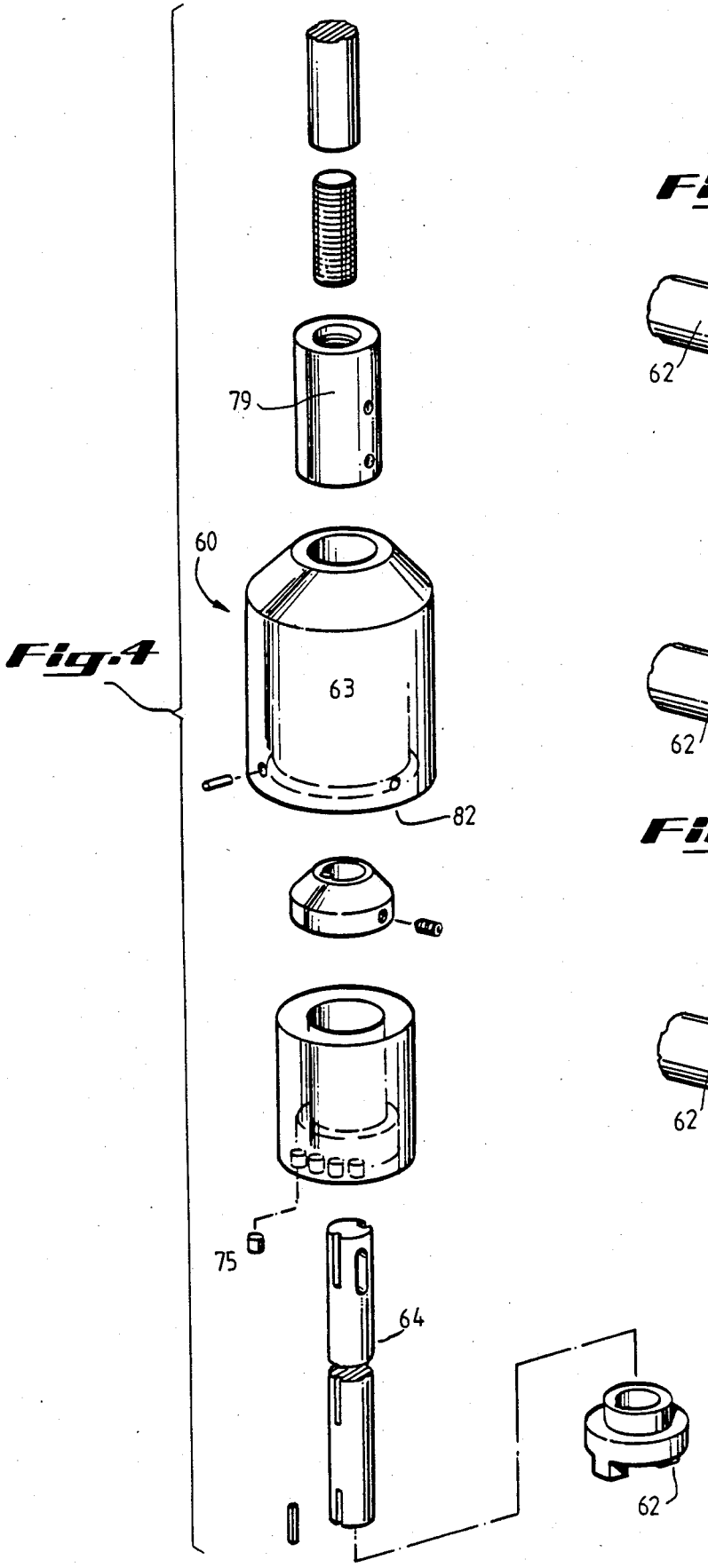
FIG. 4 is an exploded view of an embodiment of the bung removal tool of the present invention.

FIG. 4 depicts a preferred embodiment of bung engaging tool 60 and its components, again, referred to collectively as bung engaging tool assembly. As shown in FIG. 4, bung engaging tool 60 includes shaft 64, alignment housing 63, shaft support 79, bung cap retaining means 61 and bung engagement head mount means 62. Shaft 64 is connected to shaft support 79 and passes through alignment housing 63 and bung cap retaining means 61. Shaft 64 is then coupled to bung engagement head mount means 62.

Alignment housing 63 envelopes bung cap retaining means 61. Alignment housing 63 includes flange 82. This allows alignment housing 63 to fit around the flange 80 that seats bung 11, enabling bung cap retaining means 61 to align bung 11 with bunghole 81, as shown in FIG. 8.

The cross-sectional view of FIG. 8 shows that bung cap retaining means 61 has an inner cylinder 68 surrounded by an outer cylinder 69 that contains means for reliably grasping a bung cap. In one embodiment, shown in FIG. 8, a plurality of magnets 75 are used. Magnets 75 allow bung cap retaining means 61 to maintain its hold upon bung 11 after bung engagement head mount means 62 and engagement head 77 have removed bung 11.

Figure 10:
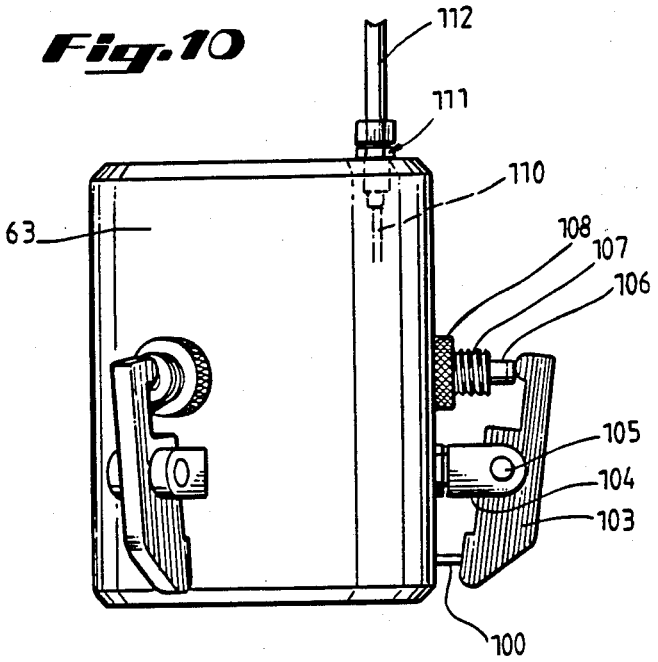
FIG. 10 is a perspective view of the preferred bung engaging apparatus of this invention.
Figure 12:
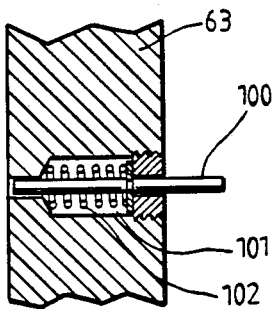
FIG. 12 is a cross sectional view of the retaining pin assembly of the preferred bung engaging apparatus of the invention.

In the most preferred embodiment of this invention, hydraulically actuated pins 100 are used to engage the bung cap. Pins 100 are slidably mounted in openings 101. Springs 102 mounted in openings 101 and connected to pins 100 bias pins 100 into outermost position (see FIG. 12). Pins 100 abut rocker arms 103 as shown in FIG. 10. Rocker arms 103 are in turn pivotally engaged by bung cap retainer means 63 by fixture 104 and retaining pin 105.

Figure 11:
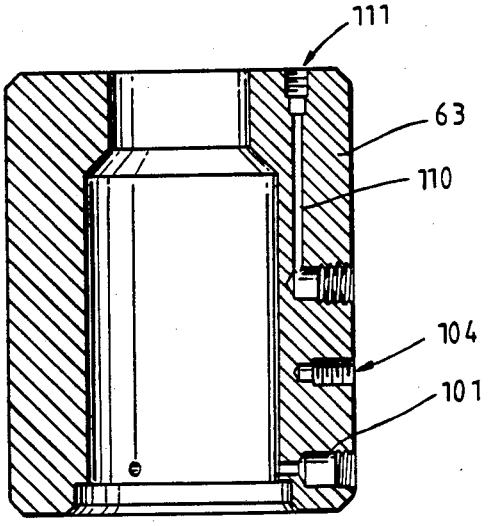
FIG. 11 is a cross sectional view of the interior hydraulic components of the preferred bung engaging apparatus of this invention.

Rocker arms 103 are likewise in abutting relationship with hydraulic fitting 106. Hydraulic fitting 106 is slidable in threaded hydraulic housing 107. Housing 107 is threaded and held in place in bung cap retaining means 63 by hex nut 108. Hydraulic housing 110 (see FIG. 11) 1 extends through cap retaining means 63 and terminates in hydraulic fitting 111. Fitting 111 is connected to flexible hydraulic hose 112 which in turn is connected to a hydraulic reservoir (not shown).

A minimum of two hydraulic assemblies are necessary to retain the bung cap although three are preferred. Fitting 111, housing 110, thread housing 107 and fitting 106 are hydraulically sealed to provide the necessary pressure to move the slidable portion of hydraulic fitting 106. Movement of fitting 106 translates into opposite movement of pins 100 through movement of rocker arms 103. By way of example, when the bung cap is being grasped, pins 100 are positioned inward while fittings 106 are positioned outward. Exactly the opposite is true when the bung cap is released. It is equally possible to substitute pneumatic components for the hydraulic components of FIGS. 10, 11 and 12.

As an alternative to the bung cap retaining means 61 shown in FIG. 4, bung cap retaining means 61 may include expansion members that may trap flange 83 of bung 11 between the expansion members and the remainder of bung engaging tool 60. FIG. 9 shows a preferred embodiment of such an alternative embodiment of bung cap retaining means 61. In that embodiment, bung cap retaining means 61 includes inner cylinder 71 and outer cylinder 72. Within the annular space 73, inside outer cylinder 72, is positioned a plurality of spring loaded nipples 76. Spring loaded nipples 76 contract as bung cap retaining means 61 engages bung 11 until nipples 76 clear flange 83 of bung 11. After nipples 76 clear flange 83, springs 74 force nipples 76 to expand, causing flange 83 to become trapped between nipples 76 and the remainder of bung engaging tool 60. From this position, the lifting of bung engaging tool 60, after bung 11 has been removed from bunghole 81, will cause bung 11 also to be lifted.

Because the embodiment of bung cap retaining means 61 shown in FIG. 9 enables bung 11 to be lifted by nipples 76 from a position underneath flange 83, the embodiment shown in FIG. 9 may be used with bungs that are nonmetallic and cannot be lifted with a magnet.

Figure 7:
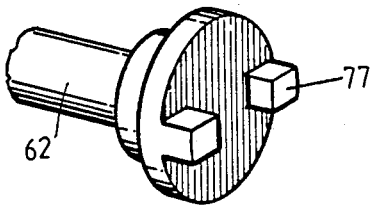
FIG. 7 is a further alternative of the embodiment of the bung removal means shown in FIG. 2.

FIG. 7 shows an embodiment of the bung engagement head mount means 62 with engagement head 77 of FIG. 4. Bung engagement head mount means 62 is attached to shaft 64 at the lower end of shaft 64. Bung engagement head mount means 62 and engagement head 77 are adapted for engagement with grooves that are formed in bung 11. The shape and position of the grooves in bung 11 dictates the shape and position of engagement head 77.

The embodiment of bung engagement head mount means 62 shown in FIG. 7 has a pair of projections forming engagement head 77. Such an embodiment is used in bungs that contain a pair of laterally displaced grooves. Engagement head 77 fits into these grooves, allowing the rotation of bung engaging tool 60 to unscrew bung 11 or to replace bung 11, depending upon the direction of rotation of bung engaging tool 60.

Figure 5:
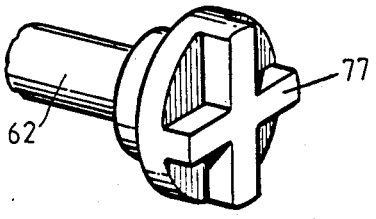
FIG. 5 is a perspective view of an embodiment of the bung removal means shown in FIG. 2.
Figure 6:
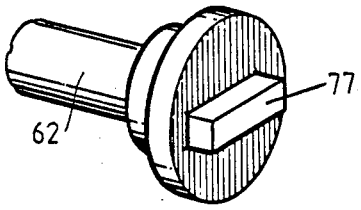
FIG. 6 is an alternative embodiment of the bung removal means shown in FIG. 2.

FIGS. 5 and 6 show alternative embodiments of bung engagement head mount means 62 and engaging head 77. The engaging head 77 of the embodiment shown in FIG. 5 has a cross shape and is used in conjunction with bungs that have a groove corresponding to this shape. The embodiment shown in FIG. 6 has an engaging head 77 in the shape of a rectangular bar to be used with a bung having a rectangular shaped groove.

FIG. 8 is a cross-sectional view of the lower end of an embodiment of bung engaging tool 60 while engaged to bung 11. FIG. 8 shows the embodiment of bung cap retaining means 61 of FIG. 4 engaged to bung 11. Magnets 75 attach bung 11 to bung cap retaining means 61 to enable bung engaging tool 60 to lift bung 11 from bunghole 81 after the busy engaging assembly has unscrewed bung 11 from bunghole 81. FIG. 8 shows an embodiment of bung engagement head mount means 62 with engaging head 77 engaged to grooves 65 in bung 11. From this position, the rotation of bung engagement head mount means 62 causes the rotation of bung 11, unscrewing bung 11 from bunghole 81. It is to be understood that in alternate embodiments of this invention the bung engagement head mount 62 and engagment head 77 may be a single integral unit. In other embodiments a variety of engagement heads 77 may be individually mounted on and removed from bung engagement head mount 62.

FIG. 8 also shows alignment housing 63. Flange 82 of alignment housing 63 envelopes flange 80 of bung 11, allowing bung cap retaining means 61 to be aligned with bung 11. The alignment of flange 82 with flange 80 also facilitates the replacement of bung 11 by insuring that bung cap retaining means 61 will align bung 11 with bunghole 81 to enable bung engagement head mount 62 to reinsert bung 11, after the liquid filling operations on container 12 have been completed.

The operation of the liquid filling apparatus of the present invention and the method for subsurface filling of a container will be explained hereinafter as would be utilized for a product being introduced into a container, which product is either subject to foaming or to giving off noxious fumes.

The container 12, which is to be filled with a predetermined weight or volume of liquid, is first appropriately positioned beneath the bung engaging tool 60. The start switch is moved, thus initiating a sequence which results in the lowering of the bung engaging tool 60 until bung cap retaining means 61 engages bung 11 and bung engagement head mount 62 and engaging head 77 engages grooves 65 of bung 11. After a short time delay, control panel 22 generates a control signal to a motor 91 or similar energy supplying means. The motor 91 then supplies power to shaft 64 of bung engaging tool 60, causing shaft 64 to rotate. The rotation of shaft 64 causes bung engagement head mount 62 to remove bung 11. After a second short time delay, control panel 22 generates a control signal to a pneumatic or other energy supplying means, causing the pneumatic device to lift bung engaging tool 60 above container 12.

In the embodiment shown in FIG. 8, magnets 75 engage bung 11 causing bung 11 to be lifted from container 12 when bung engaging tool 60 is raised. In the embodiment shown in FIG. 9, spring loaded nipples 76 engage bung 11 underneath flange 80. In this embodiment, nipples 76 trap flange 80 between nipples 76 and the remainder of bung engaging tool 60, allowing bung engaging tool 60 to lift bung 11 from container 12. In the embodiment shown in FIG. 9, bung engaging tool 60 may remove bung 11, even if bung 11 is not metallic.

Once bung engaging tool 60 has been lifted from container 12, control panel 22 generates a control signal to carriage 90, causing carriage 90 to move stanchion 92 away from a position in which bung engaging tool 60 is aligned with bung 11 to a position in which stanchion 24 and filler lance 28 is aligned with bung 11.

Once filling lance 28 is aligned with bung 11, control panel 22 generates a signal to carriage 26 causing carriage 26 to lower lance 28 into container 12 until the emission end of lance 28 is just above the bottom of the container 12.

After lance 28 has been lowered to this position, the dribble fill of the liquid into the container begins and continues for a preset interval of time (called prefill) to allow the level of liquid introduced into the container to rise above the emission end of the lance 28. This time may be set by the operator.

Once the preset interval has passed, a signal acts to open fully the control valve (described in U.S. Pat. No. 4,494,583) to permit fast fill of liquid into the container.

The fast fill condition continues until such time as the weight of the liquid in the container 12 reaches the first cut-off weight, at which time the scale 18 generates its first control signal. The first control signal may be generated when about 90% of the desired liquid weight has been achieved. This first control signal actuates a pneumatic, or other lifting means, causing carriage 26 and lance 28 to be lifted from their lowered position.

When carriage 26 begins to rise, the signal to the control valve will be interrupted thus causing the shut off of the fast-flow of liquid into the container 12. Once lance 28 has reached its raised position within container 12, a second dribble fill begins and continues until a second cut-off weight is reached. Once this second cut-off weight is reached, the flow of liquid shuts off and lance 28 is raised to its raised position.

After the flow of liquid into container 12 is shut off and lance 28 is lifted from container 12, control panel 22 generates a control signal to carriage 90, that causes carriage 90 to transport stanchion 24 away from a position in which lance 28 is aligned with bung 11 and causes stanchion 92 to move to a position in which bung engaging tool 60 is aligned with bung 11. Once bung engaging tool 60 is aligned with bung 11, control panel 22 generates a control signal to a pneumatic, or other lifting device, causing it to lower bung engaging tool 60 until bung cap retaining means 61, still engaged to bung 11, engages bunghole 81.

In the embodiment shown in FIG. 4, bung cap retaining means 61 aligns bung 11 as bung 11 is reinserted into bunghole 81 of container 12. Flange 82 of alignment housing 63 aligns bung 11 with flange 80 of bunghole 81 of container 12, enabling bung 11 to be aligned with bunghole 81.

Once bung 11 is aligned with bunghole 81, control panel 22 generates a control signal to motor 91, or other energy supplying means. In response to this control signal, the motor 91 causes shaft 64 to rotate in the direction opposite to the direction of rotation that allowed the bung engaging tool 60 to remove bung 11. The rotation of shaft 64 causes bung engagement head mount 62 and engagement head 77 to rotate in a direction that causes bung 11 to be threaded into bunghole 81, effecting the reinsertion of bung 11.

As described in U.S. Pat. No. 4,494,583, alignment means, such as a driven roller means together with a sensing means, may be used to align the bung 11. As described in that patent, such a roller drive may be powered by suitable electrical or mechanical means such as an electric or pneumatic motor in response to control signals.

Having described the preferred embodiment of the invention, those skilled in the art may effect numerous modifications thereto in view of the foregoing description. It is, however, understood that such modifications lie within the contemplation and scope of this invention as defined in the appended claims.

What is claimed is:

1. Liquid filling apparatus for subsurface filling of containers comprising:

(a) a conduit for introducing liquid into a container, said conduit being movable between a raised and lowered position;

(b) a signal generator for generating a signal to initiate movement of said conduit from its raised position to its lowered position;

(c) a weight responsive device adapted to generate a control signal when the weight of said liquid in said container equals a cut-off weight, said control signal being operable to initiate withdrawal of said conduit toward its raised position; and (d) a bung engaging tool, said tool being movable between a raised and lowered position and having means for attaching to and removing said bung of said container.

2. The liquid filling apparatus of claim 1 further comprising a sensing mechanism for aligning the bung of said container with said bung removal tool and said conduit, said sensing mechanism being operated in cooperation with container rotating means.

3. The liquid filling apparatus of claim 1 further comprising a valve to control the rate of flow of liquid through said conduit to said container.

4. The liquid filling apparatus of claim 1 further comprising a signal generator for generating a signal to initiate movement of said bung removal tool from its raised position to its lowered position in which said bung removal tool engages said bung of said container.

5. The liquid filling apparatus of claim 1 further comprising a signal generator for generating a signal to initiate movement of said bung removal tool, after said tool has engaged said bung, causing said tool to remove said bung and to subsequently move from its lowered position to its raised position.

6. The liquid filling apparatus of claim 1 further comprising a signal generator for generating a signal to initiate movement of said apparatus from a position in which said bung of said container is aligned with said bung removal tool to a position in which said bung of said container is aligned with said conduit.

7. The liquid filling apparatus of claim 2 further comprising a signal generator for generating a signal to initiate movement of said conduit from its raised position to its lowered position said signal generator being actuated by said sensing mechanism.

8. The liquid filling apparatus of claim 3 further comprising a signal generator, actuable by movement of the conduit towards its lowered position, for generating a signal to actuate the valve to commence flow of liquid at a slow fill rate into said container.

9. The liquid filling apparatus of claim 8 further comprising a delay mechanism actuable by the signal from said signal generator to trigger a fast fill rate dispensation of liquid after a predetermined interval.

10. The liquid filling apparatus of claim 1 further comprising a signal generator actuable when the conduit has been raised a predetermined distance from said container for generating a signal to stop further movement of said conduit.

11. The liquid filling apparatus of claim 1 wherein said bung engaging tool includes:

a shaft;

an alignment housing inserted on said shaft;

bung cap retaining means mounted on said shaft for attaching said bung engaging tool to said bung; and bung engaging means mounted on the distal end of said shaft for removing said bung.

12. The liquid filling apparatus of claim 11 wherein said bung cap retaining means includes an outer cylinder which includes hydraulic means for grasping said bung cap when said bung engaging tool raises said bung cap from said container.

13. The liquid filling apparatus of claim 11 wherein said bung cap retaining means includes an outer cylinder which includes expansion means for attaching to a non-metallic bung when said bung engaging tool raises said bung cap from said container.

14. Liquid filling apparatus for subsurface filling of containers comprising:

(a) a conduit for introducing liquid into a container, said conduit being movable between a raised and lowered position;

(b) a valve to control the rate of flow of said liquid through said conduit to said container;

(c) first and second signal generators for initiating movement of said conduit from its raised position to its lowered position and for actuating the valve to commence flow of liquid;

(d) a weight responsive device adapted to generate a control signal when the weight of said liquid in said container equals a cut-off weight, said control signal being operable to initiate withdrawal of said conduit toward its raised position;

(e) a bung engaging tool, said tool being movable between a raised and lowered position and having means for attaching to said bung cap of said container; and (f) additional signal generators for 1) generating a signal to initiate movement of said bung engaging tool from its raised to its lowered position, in which said bung engaging tool engages said bung cap of said container, 2) generating a signal to initiate movement of said bung engaging tool, after said tool has engaged said bung cap, causing said tool to remove said bung cap and to subsequently move from its lowered position to its raised position, and 3) generating a signal to initiate movement of said apparatus from a position in which said bung cap of said container is aligned with said bung engaging tool to a position in which said bung cap of said container is aligned with said conduit.

15. The liquid filling apparatus of claim 14 further comprising a delay mechanism actuable by the signal from said second signal generator to trigger a fast fill rate dispensation of liquid after a predetermined interval.

16. The liquid filling apparatus of claim 14 further comprising a signal generator actuable when the conduit has been raised a predetermined distance from said container for generating a signal to stop further movement of said conduit.

17. In liquid filling apparatus adapted for subsurface filling of containers, said apparatus including: a conduit for introducing liquid into a container, said conduit being movable between a raised and a lowered position; a valve to control the rate of flow of liquid through the conduit to said container; a first signal generator for generating a signal to initiate movement of the conduit from its raised position to its lowered position; a second signal generator actuable by movement of the conduit toward its lowered position, for generating a signal to actuate the valve to commence flow of liquid at a slow fill rate into said container; a delay mechanism actuable by the signal from the second signal generator to trigger a fast fill rate dispensation of liquid after a predetermined interval; a weight responsive device adapted to generate a first and a second control signal when the weight of the liquid in the container equals a first and a second cut-off weight, respectively, said first control signal being operable to initiate withdrawal of the conduit towards its raised position and to actuate the valve to return to a slow fill rate of dispensation of liquid through the conduit; and a third signal generator actuable when the conduit has been raised a predetermined distance from said container for generating a signal to stop further movement of the conduit; said second control signal, which is generated when the second cut-off weight of liquid within said container is achieved, initiating the termination of flow of liquid from the conduit and the movement of the conduit to its raised position, the improvement which comprises:

a bung engaging tool, said tool being movable between a raised and lowered position, and including:

a shaft;

an alignment housing inserted onto said shaft;

bung cap retaining means engaged to said shaft for retaining said bung cap in said bung engaging tool; and bung engaging means mounted to the distal end of said shaft for rotating an engaging head inserted into said bung cap and thus removing said bung cap from said container; and fourth, fifth and sixth signal generators for 1) generating a signal to initiate movement of said bung engaging tool from its raised to its lowered position, in which said bung cap retaining tool engages said bung cap of said container, 2) generating a signal to initiate movement of said bung engaging tool, after said tool has engaged said bung cap, causing said tool to remove said bung cap and to move from its lowered position to its raised position, and 3) generating a signal to initiate movement of said apparatus from a position in which said bung cap of said container is aligned with said bung engaging tool to a position in which said bung cap of said container is aligned with said conduit.

18. A method for filling a container with a predetermined weight of liquid, which liquid is subject to foaming or the production of toxic or noxious fumes, comprising the steps of:

removing a bung cap from said container with a bung engaging tool assembly;

transporting a carriage containing said bung engaging tool assembly and a conduit for the introduction of liquid into the container from a position in which said bung engaging tool assembly is aligned with said bung caps to a position in which said conduit is aligned with the bung opening;

actuating the movement of said conduit to a predetermined position just above the bottom of the container;

introducing liquid into the container at a first dribble fill rate for a predetermined time interval until the end of the conduit is submerged in the liquids;

increasing the liquid introduction to a fast fill rate until a predetermined first cut-off weight of liquid in the container is achieved;

decreasing the rate of liquid introduction to a second dribble fill rate in response to a signal generated when said predetermined first cut-off weight is achieved;

initiating full shut-off of liquid flow through the conduit from the container and the lifting of said conduit to its raised position in response to a signal generated when a predetermined second cut-off weight is achieved;

transporting said carriage from a position in which said conduit is aligned with said bung opening to a position in which said bung engaging tool assembly is aligned with said bunghole; and replacing said bung cap with said bung engaging tool assembly.

* * * * *